United States Patent [19]

Micheletti

[11] 4,044,574

[45] Aug. 30, 1977

[54] METHOD OF CLOSING THE TOE OPENING OF A KNIT STOCKING OR THE LIKE

[75] Inventor: Arrigo Micheletti, Florence, Italy

[73] Assignee: Billi, S.p.A., Italy

[21] Appl. No.: 764,835

[22] Filed: Oct. 3, 1968

[30] Foreign Application Priority Data

Oct. 9, 1967 Italy ..... 4763/67

[51] Int. Cl.[2] ..... A41B 11/02; D04B 9/42

[52] U.S. Cl. ..... 66/187; 66/125 R

[58] Field of Search ..... 66/1, 19, 21, 22, 26, 66/9, 41, 80, 95, 134, 133, 125, 146, 147, 148, 169, 170, 171, 173, 174, 172, 184, 185, 186, 187, 201; 2/239, 21; 128/155, 156, 290, 296

[56] References Cited

U.S. PATENT DOCUMENTS

| | | | |
|---|---|---|---|
| 761,592 | 5/1904 | Lippitt | 273/82 UX |
| 966,746 | 8/1910 | Hoefer et al. | 66/1 |
| 1,443,999 | 2/1923 | Merli et al. | 66/146 X |
| 1,520,162 | 12/1924 | Vittori et al. | 66/9 |
| 1,533,868 | 4/1925 | Kingman | 66/170 UX |
| 1,829,086 | 10/1931 | Grasham | 66/187 UX |
| 2,020,556 | 11/1935 | Kirkpatrick | 66/1 |
| 2,069,021 | 1/1937 | Schuessler | 66/171 |
| 2,292,231 | 8/1942 | Lesavoy | 66/9 X |
| 2,326,997 | 8/1943 | Hochman | 66/170 UX |
| 2,522,842 | 9/1950 | Scholl | 2/21 |
| 2,601,771 | 7/1952 | Cameron | 66/170 |
| 2,636,492 | 4/1953 | Wright | 2/21 X |
| 2,747,390 | 5/1956 | Reymes-Cole | 66/41 X |
| 3,184,236 | 5/1965 | Zens | 273/82 |
| 3,236,070 | 2/1966 | Clayton, Jr. | 66/187 UX |
| 3,252,307 | 5/1966 | Kaese | 66/134 |
| 3,254,509 | 6/1966 | Tenconi | 6/41 |
| 3,340,706 | 9/1967 | Currier | 66/1 X |
| 3,345,699 | 10/1967 | Burger | 66/9 X |

FOREIGN PATENT DOCUMENTS

| | | | |
|---|---|---|---|
| 1,542,833 | 9/1968 | France | 66/145 S |
| 673,481 | 11/1964 | Italy | 66/140 |

*Primary Examiner*—Ronald Feldbaum
*Attorney, Agent, or Firm*—Clifton T. Hunt, Jr.

[57] ABSTRACT

Closing the toe opening of a stocking, or the end of a tube by providing a two ply welt defining the toe pocket, and constricting the fabric of at least one of said plys about the axis of the toe opening to obstruct the same. The constriction or gathering of the fabric is effected by winding a thread about the fabric. The knitting of the stocking and the welt and the closing of the opening are carried out automatically, as an integrated operation and on a single machine.

A stocking, the toe pocket of which is defined by a two ply welt having an end opening, said opening being closed by gathering fabric there-across.

2 Claims, 16 Drawing Figures

Fig. 1
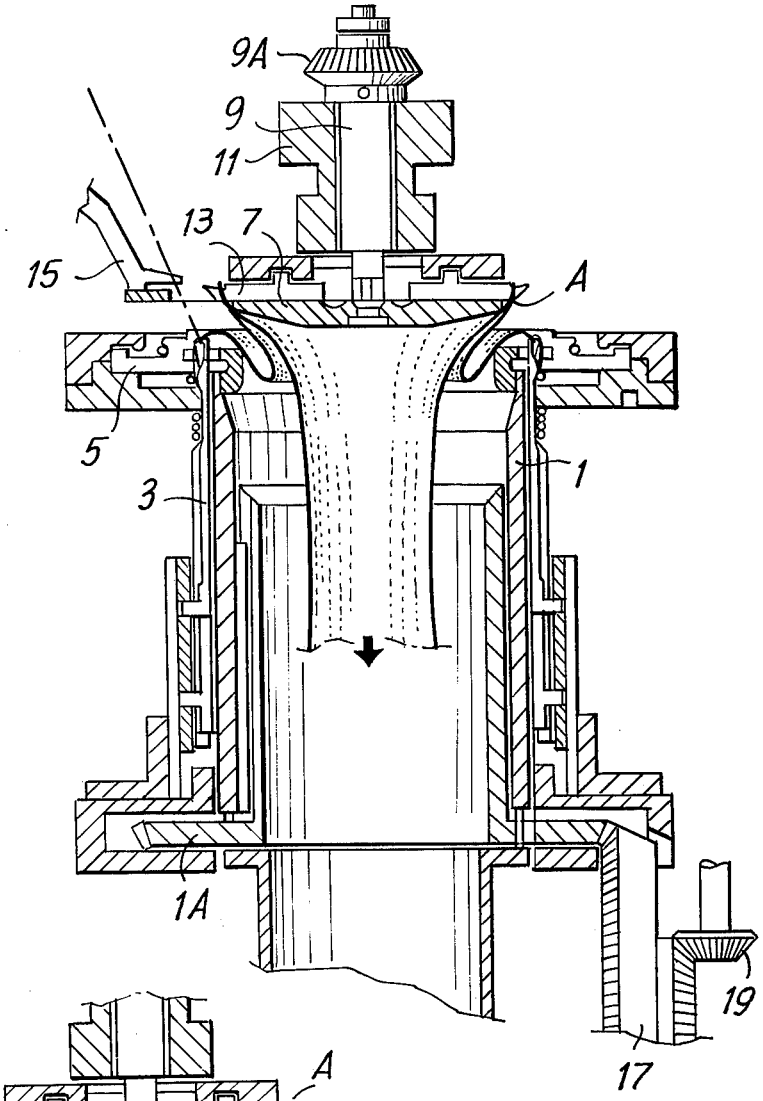
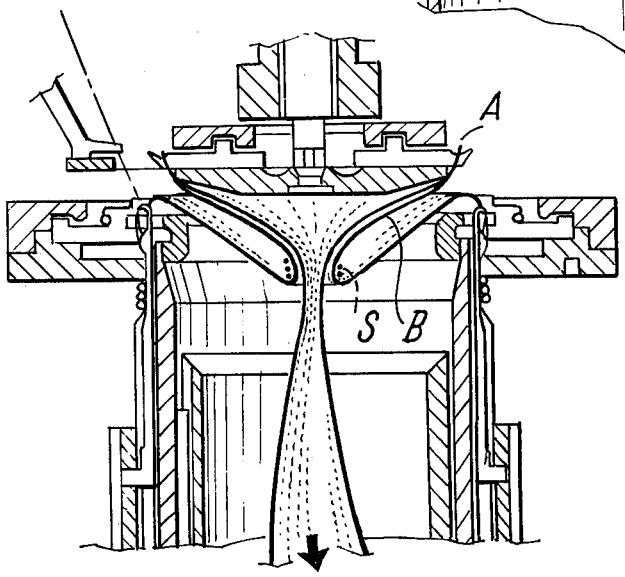
Fig. 2
ARRIGO MICHELETTI
By Necho and Kimmelman

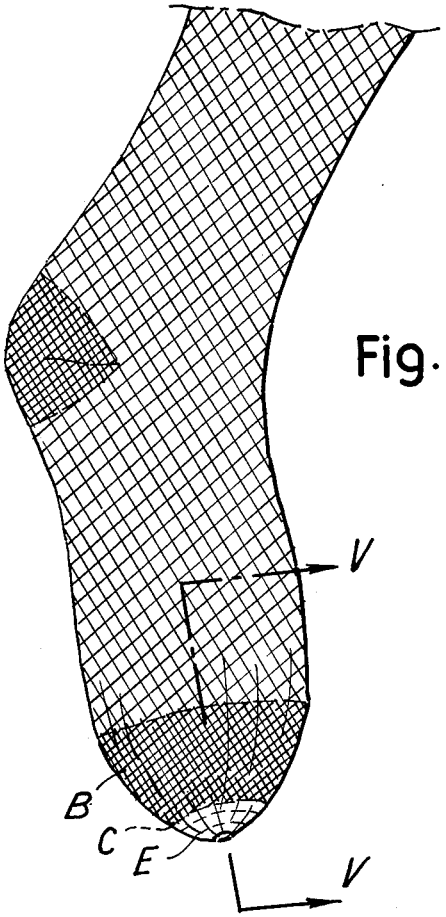
Fig. 4
Fig. 3
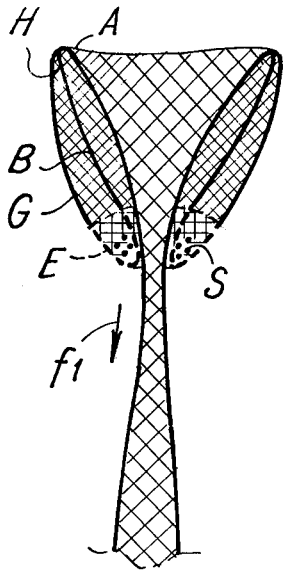
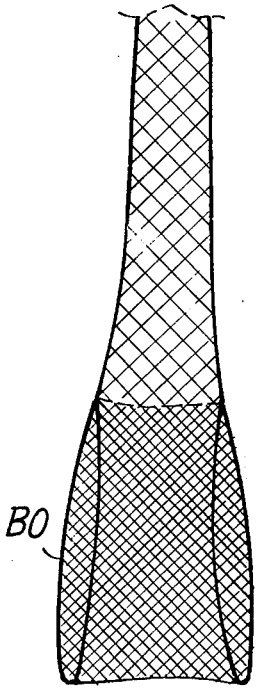
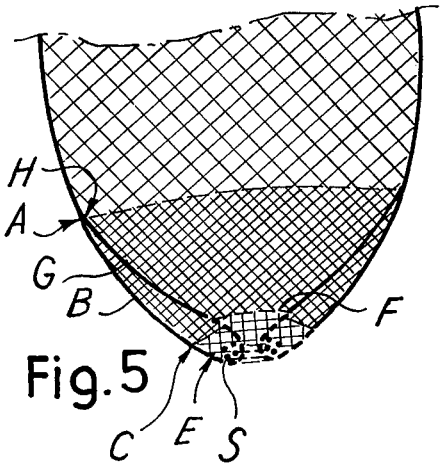
Fig. 5
ARRIGO MICHELETTI
By Necho and Kimmelman ARRIGO MICHELETTI
BY Necho and Kimmelman

ARRIGO MICHELETTI

BY Necho and Kimmelman

ARRIGO MICHELETTI

By Necho and Kimmelman

ARRIGO MICHELETTI
BY Pecho and Kimmelman

METHOD OF CLOSING THE TOE OPENING OF A KNIT STOCKING OR THE LIKE

THE BACKGROUND

Closing the toe opening of any stocking has always presented a problem and the many patents issued in this and other countries, attest to the magnitude of the problem. Sewing the edges of the toe opening involved another operation and it left a seam which, being unsightly, is located at the bottom of the stocking where it is uncomfortable. The most recent development of which I am aware is shown in U.S. Pat. No. 3,340,706. This involved rotating the dial of the knitting machine through an angle of 360°. This method left much to be desired because it produced excessive bunching of the fabric which detracted from the appearance of the stockings and caused discomfort to the wearer.

THE INVENTION

The invention resides in a novel method of closing the toe opening of a knit stocking, (or the open end of other knit tube) during the knitting operation and on the same machine, so as to dispense with the separate toe closing operation which has heretofore been indispensable.

The invention also resides in closing the toe opening without causing unsightly and uncomfortable bunching of the fabric.

The invention still further relates to a method of closing the toe opening of a stocking which permits the knitting of the stocking to commence at the top or at the toe or at the end of the stocking.

More specifically, the invention resides in knitting the toe portion of the stocking in the form of a turned twoply welt the same as the welt which is conventionally provided at the top end of the stocking; in winding a yarn around at least one of said plys to gather and constrict the fabric about the axis of the opening to close the latter.

In the embodiment shown In FIGS. 1 through 7, the invention is carried out by knitting the inner ply of the welt; knitting an inter-connecting portion; knitting the outer ply; folding it over the inner ply along a line lying within the borders of the inter-connecting portion, and securing the outer edge of the outer ply to the inner edge of the inner ply, or to the fabric adjacent the junction of the inner ply with the main fabric immediately adjacent the toe of the stocking.

In the embodiment shown in FIGS. 9 through 16, the invention is carried out by knitting a two-ply toe welt with the plys nested, one with the other, and constricting the central portion of at least one of the plys.

IN THE DRAWINGS

FIG. 1 is a view, partly in elevation and partly in vertical section, and shows the first step in making a stocking according to the first embodiment of the invention.

FIG. 2 is similar to FIG. 1 and shows the stocking after the inner ply of the toe welt has been gathered or constricted by a yarn wrapped tightly around it.

FIG. 3 is a diagrammatic view showing the stocking of FIG. 2 as it comes off the machine.

FIG. 4 is a side elevational view of the lower portion of a stocking, the toe opening of which is closed according to my invention.

FIG. 5 is a sectional view looking in the direction of line V—V on FIG. 4.

Figure 6:
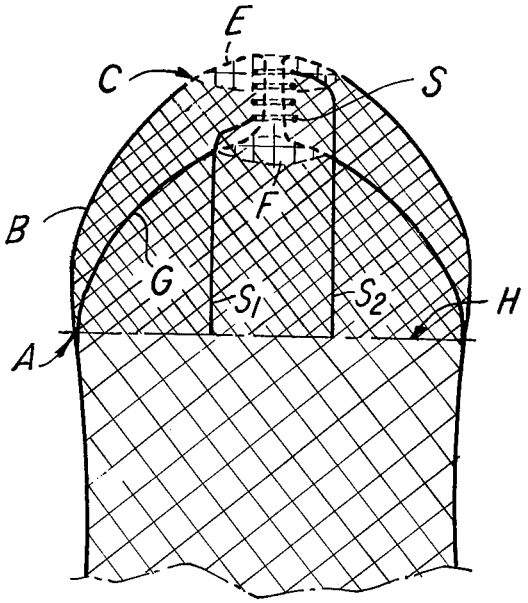
FIG. 6 is similar to FIG. 5 and shows details of construction.

As best shown in FIGS. 1 and 2 of the drawings, 1 designates the needle cylinder; 3 the needles; 5 the sinkers which are borne by an annular structure integral with the upper end of the cylinder; 7 the dial or plate which is rotated by a shaft; 9 which is co-axial with the needle cylinder and is carried by a suitable structure 11 which overlies the needle cylinder. 13 denotes the hooks which are borne by the dial or plate 7; 15 denotes a yarn guide for supplying yarn to a corresponding feed, it being understood that the machine can have more than one feed and that there can be more than one yarn guide at each feed. In order to ensure that the needle cylinder and the dial will rotate in exact unison, there is provided a double-toothed ring 17 which actuates bevel ring gear 1A of the needle cylinder and bevel gear 19 which is operatively connected to bevel gear 9A of shaft 9. The needle cylinder is provided with the usual compliment of control profiles and cams which selectively control the raising and lowering of needles and which may operate on the needle butts directly or through jacks.

Circular knitting machines have for some time been equipped to produce a double walled, or two ply, welt such as welt BO which defines the upper end of the finished stocking, FIG. 3. Conventionally, this upper welt is formed at the beginning of the knitting operation, but it can be knit at the end, if desired.

In the interest of brevity, the parts above referred to and their adjuncts, which may take any conventional form, are not shown, nor described, in detail.

According to this invention, I knit another two-ply welt at the lower end of the stocking so as to define the toe opening. For convenience, and to distinguish it from the conventional upper welt, this welt will be referred to as the lower or toe welt. This toe welt is formed automatically as a part of the knitting operation which may commence at the upper or lower end of the stocking.

According to a prime feature of this invention, the toe opening of the stocking (which, now, is defined by the toe welt) is closed, not by sewing, or by knitting, but by constricting or strangulating the toe welt by means of a yarn tightly wound thereabout at, or near, the fold line of the welt; by turning the outer ply over the inner ply and fastening the edge of the outer ply to the fabric of the inner ply and/or to the main fabric of the stocking at or near its junction with the inner ply. This produces a tight closure and attractive "sun-burst" at the toe of the stocking.

More particularly, at a point A in the knitting of the foot of the stocking, the hooks 13 of the dial are actuated to supportingly receive thereon a course of stitches so as to support the fabric during the knitting of the toe welt. FIGS. 1, 2 and 3. The knitting is now continued to form portion B which, ultimately, becomes the inner ply of the toe welt. When the portion B (between lines A and C) has been knit, with or without a change of yarn, I proceed to knit intermediate portion E which separates portions B and G. Preferably a thinner yarn is used for knitting portion E so as to facilitate the turning of outer ply G of the welt over inner ply B. Also, the yarn for knitting portion E, and/or the inner and outer plys, can be elastic. After portion E has been knit and at about demarcation line F, the knitting of outer ply G is begun and is continued until line H is reached. It will be noted that plys B and G are substantially co-extensive so that when the welt is turned, edge H of outer ply G will overlie edge A of the inner ply B. Outer ply G is turned over inner ply B along a fold line which is at the center of portion E.

Figure 7:
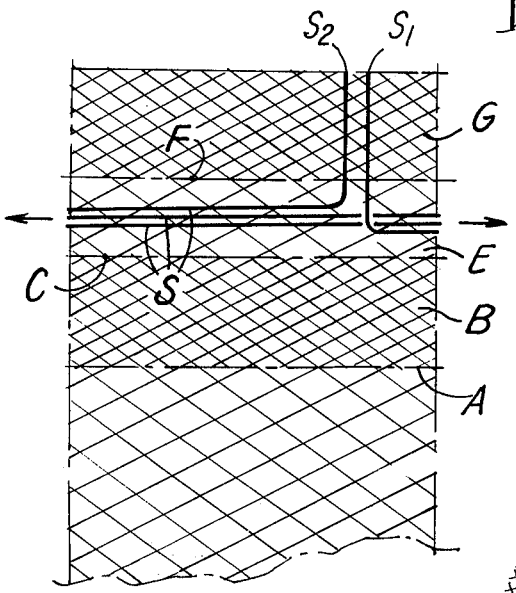
FIG. 7 is a diagrammatic view of the toe portion of a hose in which the welt has been opened up and the fabric thereof disposed in non-constricted condition upon a flat plane to schematically indicate the relationship between the welt and the source of the constricting yarn as well as the turns thereof, the turns being shown unduly elongated for demostrative purposes only.

During the knitting of the toe welt, the needles at one or more selected yarn feed stations are moved to a non-knitting and non-casting off position whereby the needles no longer take the yarn from the yarn guide. In this embodiment, the yarn or yarns extending from the yarn guide, and which were used in the knitting of the inner ply B as diagrammatically shown at S1 is held on the needle which last took the yarn S. The rotation of the needle cylinder thus causes the yarn to wind around the fabric already formed, through a desired number of turns, so as to gather or constrict the fabric, as diagrammatically shown in FIG. 2. When this has been accomplished, the needles are returned to the knitting position at the previously mentioned yarn feed stations, so that they resume the knitting of the constricting yarn into the fabric of outer ply G as diagrammatically shown in FIG. 2 and at S2 in FIG. 7. Outer ply G is then turned down, as viewed in FIG. 7, so as to overlie inner ply B and its outer edge H is suitably secured to the inner edge A of inner ply B. It will be understood that the constricting yarn S is fed under an increased order of tension by means of any conventional yarn tensioning device so as to gather the fabric tightly enough so that, for all intents and purposes, the toe opening can be considered as adequately closed.

Instead of using a single yarn S, it is within the scope of the invention to use a number of yarns. The fabric of the toe welt can be of any stitch and in any pattern.

The machine may include the usual suction downtake which acts on the fabric to produce the "loop," which is diagrammatically shown in FIGS. 1, 2, and 3. At the end of the knitting of outer ply G, as indicated by line H, the outer ply is turned over the inner ply B and its edge H is secured to edge A of the inner ply in a well known manner to complete the knitting of the stocking. As pointed out above, the knitting of the stocking can begin with the conventional welt BO, or it can begin at H, the edge of toe welt, and proceed to the end of welt BO. The completed stocking will have the appearance of FIG. 3, and is transformed to the finished, or ready-to-wear condition of FIG. 4 by relative slipping and introflection of plys B and G within turns S in the direction of arrow f1 in FIG. 3.

Plys B and G and other portions of the fabric may be formed of patterned stitches, and of plain or of elastic yarn. Inter-connecting portion E is preferably knit of a smaller denier yarn to facilitate folding of the outer ply G over the inner ply B and to reduce the mass of fabric which is gathered to close the toe opening. The use of elastic yarn improves the adherence of the constricting turns to the fabric.

Figure 8:
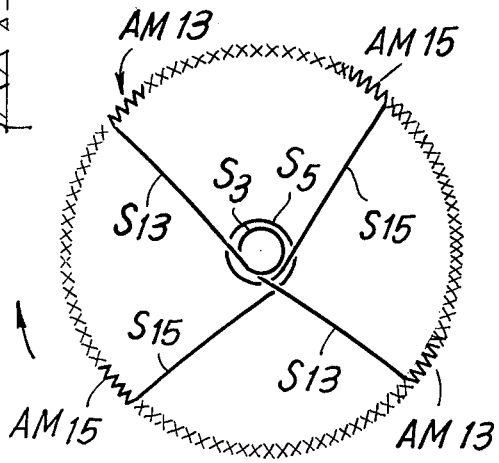
FIG. 8 is a cross-sectional view of a modified form of the invention in which a pair of constricting yarns, which are other than the yarns used in knitting the toe welt, are used to close the latter.

In FIG. 8, I show the fabric gathered by turn or turns S3 formed of yarn S13, and by turn or turns S5 made of yarn S15. Yarns S13 and S15 are other than those used for the knitting operation. The ends of yarns S13 and S15 are suitably anchored to the fabric before, and after, formation of the turns S3 and S5. Conveniently, the ends of the yarns S13 and S15 are engaged with needles which knit said yarn ends into the fabric as at AM13 and AM15, respectively.

In the embodiment of FIGS. 9 to 15, 21 is the needle cylinder which is provided with an upper inner rim 23 and an upper outer rim 25, which are provided with radial grooves for the sinkers 27 in the usual manner. 29 denotes the knitting needles, some of which are in the raised knitting position as at 29A and some of which are in the depressed, non-knitting, fabric-holding position, as at 29B. 31 denotes the rotary plate or dial which underlies a fixed disc-like structure 33 and is coaxial with the needle cylinder.

Figure 9:
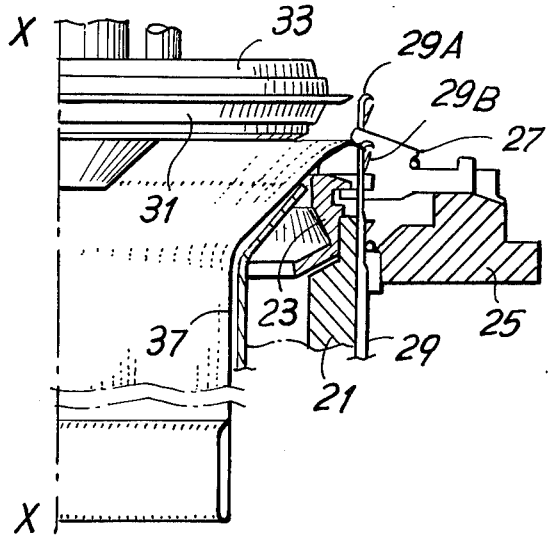
FIGS. 9 to 15 are fragmentary and diagrammatic views illustrating the steps of another method of producing a closed toe stocking.
Figure 10:
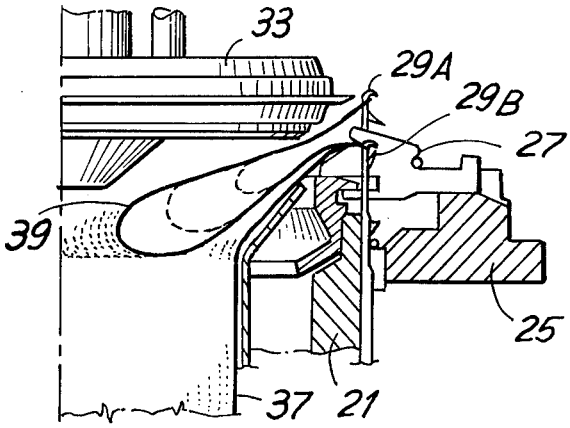
Figure 11:
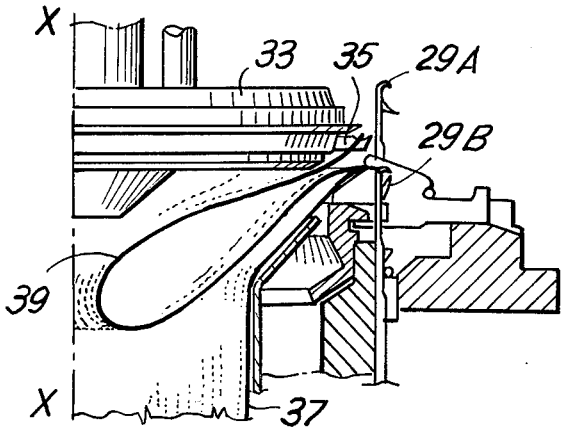

Dial 31 and its supporting structure are movable along axis X—X, which is the axis of the needle cylinder. FIG. 9. Dial 31 carries radial hooks 35 which may be projected and retracted. As in the previously described embodiment, the machine is capable of producing a stocking having a turned, two-ply welt defining the upper end of the stocking.

Since the knitting operation as such, and including the formation of the welt, is well known, it is thought that no detailed description thereof is needed. It is sufficient to point out that, as illustrated in FIG. 9, the knitting operation has proceeded to the beginning of the toe.

Figure 12:
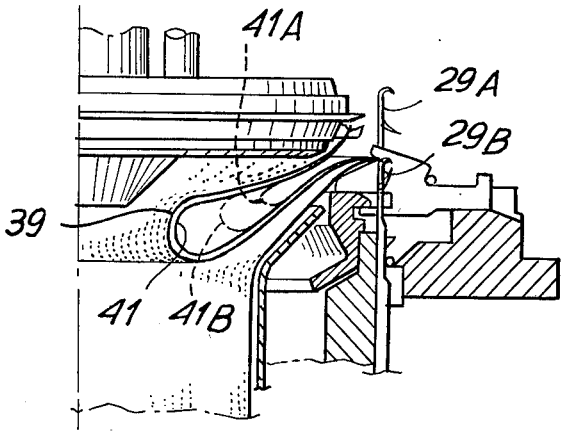
Figure 13:
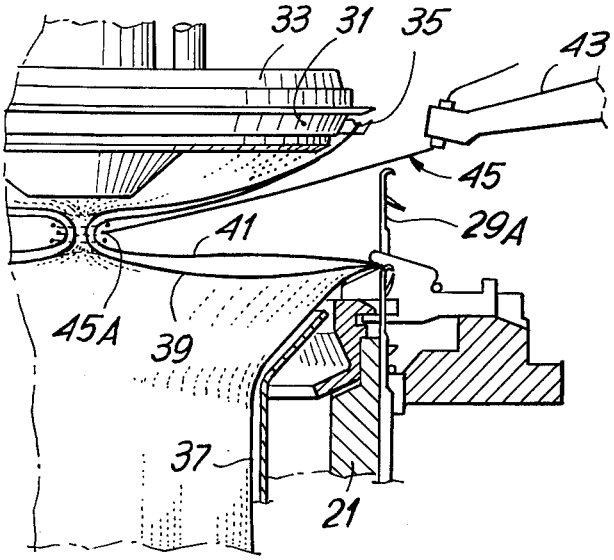
Figure 14:
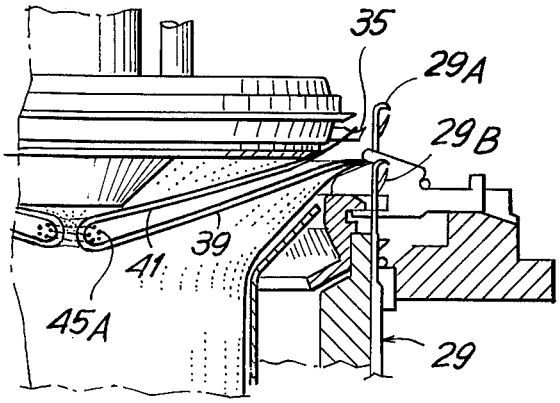
Figure 15:
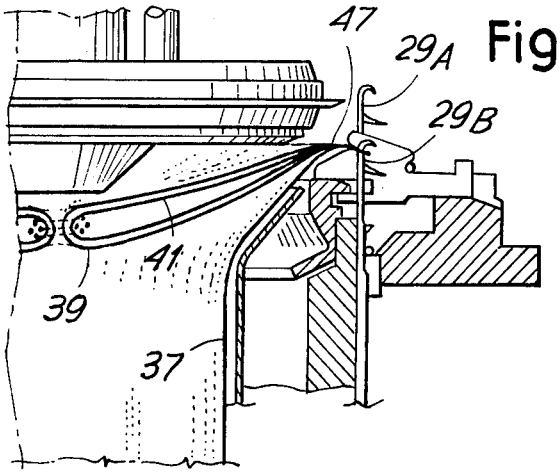
Figure 16:
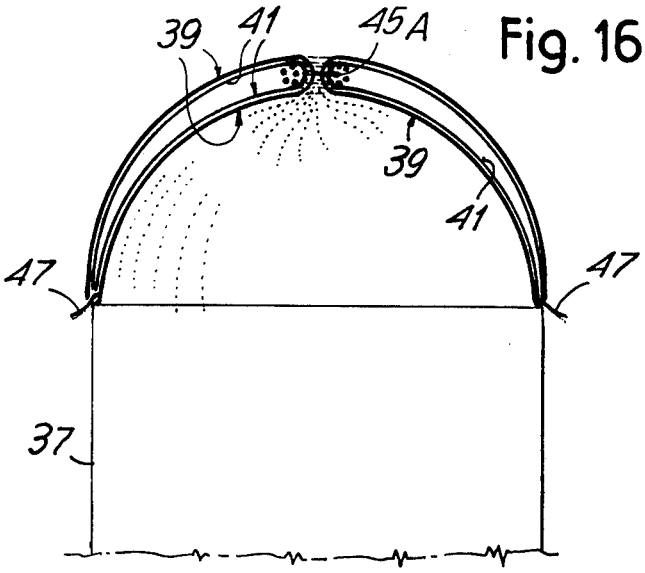
FIG. 16 is a sectional view showing the structure of a stocking made according to the second embodiment of this invention.

The main fabric 37 of the stocking is knit by the full compliment of needles while the toe fabric is knit by half the number of needles. For example, if the needle cylinder has 400 needles, every other needle is kept depressed as at 29B so as to hold the fabric and the initial edge of pocket 39, while alternate needles 29 are allowed to knit so as to form pocket 39. It follows that the number of stitches per course of the fabric of pocket 39, is one-half the number of stitches per course of fabric 37. When pocket 39 has attained the desired size, the welt hooks 35 are actuated to supportingly receive thereon the bights of yarn between the stitches formed on needles 29A in the terminal course of said welt 39 to support the same and the fabric of the second welt 41 as the machine now begins to knit the same on needles 29A, the fabric of welt 41 extending between the hooks 35 and the needles 29A as it is being knit by the latter. It will be noted that pocket 41, the development of which is shown at 41A and 41B, FIG. 12, is formed within pocket 39, FIG. 13. It will be understood that as in the development of pocket 39, needles 29B are in the depressed position in which they hold the fabric but do not knit. As the size of pocket 41 approaches the size of pocket 39, or just before completion of pocket 41, the fabrics of the two pockets are tied together by windings of a yarn 45 which is supplied by yarn guide 43. This operation is as follows: Dial 31 is raised to raise hooks 35 which carry the initial edges of pockets 39 and 41, and yarn guide 43 is lowered to begin to supply yarn 45 to knitting needles 29A which knit the yarn to anchor it to the fabric of pocket 41 which is being formed. As soon as this is accomplished, the yarn guide 43 is raised to an intermediate position which is high enough to take yarn 45 out of reach of the knitting needles but which is not high enough to place the yarn 45 within the reach of the conventional clamp and cutter which will act upon the yarn 45 in the usual manner when the guide is fully raised at the end of the operation. With the yarn guide at this intermediate height, the rotation of the needle cylinder causes yarn 45 to wind through the desired number of turns, around the nested fabrics of pockets 39 and 41, as at 45A in FIG. 14. As soon as yarn 45 has been wound as at 45A, the yarn guide is lowered to permit the yarn to be engaged by needles 29A which knit it into the fabric of pocket 41 to anchor the yarn, as in the manner previously explained. As soon as this is done, the yarn guide 43 is raised out of operation and the dial 31 lowered to continue the knitting of pocket 41 until it becomes substantially co-extensive with pocket 39. At this point, hooks 35 are actuated to transfer the bights of yarn of the common terminal course of pockets 39 and 41 on to the now activated needles 29B. This is accomplished in the well-known manner in which conventional welts are formed. After the transfer referred to, one or more courses are knit firmly to secure the junction of the cleared stitches. At this point, needles 29B are activated and a few ravel courses are knit, as at 47.

It is to be understood that yarn 45 is fed under the desired tension and that it may be of any denier and of any texture, and that it may be a plain or a stretch yarn. Also, while, for convenience, reference was made to one yarn 45, it is within the scope of this invention to use more than one constricting yarn.

It will be noted that, according to the second embodiment, the plys of the toe welt are knit one within the other, and are both constricted by yarn (or yarns) 45 to provide a closed toe.

As used in the foregoing description and in the appended claims:

"Yarn" includes any yarn;

One yarn includes a plurality of yarns;

One feed includes a plurality of feeds;

"Stocking" includes any knit tube;

Knitting machine includes any machine capable of knitting a two-ply welt at the beginning or at the end of a stocking.

What I claim is:

1. The method of operating a circular knitting machine of the type having a circle of needles and having a circle of welt hooks associated with said circle of needles, which comprises knitting a first section of tubular fabric on said needles, positioning spaced needles at welt level with their last formed stitches of said first fabric section thereon, knitting a second section of tubular fabric of predetermined length on the intervening needles in continuation of the corresponding intervening wales of said first fabric section, holding the terminal course of said second fabric section on said circle of welt hooks, knitting a third section of tubular fabric of said predetermined length in continuation of said terminal course, said terminal course being a course common to said second and to said third fabric sections, said second and third fabric sections being nested and commonly extending between said circle of welt hooks and said intervening needles, winding yarn under tension peripherally around said nested tubular fabric sections midway of their length to constrict the same to effectively close the opening therein, whereby said pair of nested two-ply welts is closed at the fold line thereof to produce a closed toe for a stocking, activating said spaced needles, transferring said terminal course from said welt hooks to said spaced needles, knitting upon said circle of needles to join the terminal courses of said tubular sections to form a pair of nested, two-ply tubular welts, and knitting a further portion of tubular fabric on said needles.

2. A method of forming and closing one end of a fabric tube on a circular knitting machine having a circle of needles adapted for rotary operation, a circle of dial bits cooperating with alternate needles of said circle and means for feeding yarns to said circle of needles, including the steps of:

a. knitting yarn fed to said circle of needles and forming courses of said fabric tube including a terminal course thereof, b. inactivating alternate needles of said circle of needles with stitches of said terminal course of said tube suspended thereon, c. knitting yarn fed to needles of said circle of needles intermediate said alternate needles and forming courses of first and second plies of a first doubled portion including an inner terminal course of said first ply connected to stitches of said terminal course of said tube, an inner terminal course of said second ply and outer connected terminal courses defining an outer end of said one end of said fabric tube, d. engaging said dial bits with bights of yarn connecting the stitches of said inner terminal course of said second ply, e. knitting yarns fed to said intermediate needles and forming courses of third and fourth plies of a second doubled portion including an inner terminal course of said third ply connected to said inner terminal course of said second ply, outer connected terminal courses of said third and fourth plies adjacent said outer terminal courses of said first and second plies and an inner terminal course of said fourth ply, f. gathering said outer terminal courses of said first and second doubled portions into a bunch to close said outer end of said one end of said fabric tube, g. transferring said yarn bights of said inner terminal course of said second ply from said dial bits to said alternate needles and enclosing said third and fourth plies of said second doubled portion within said first and second plies of said first doubled portion, and h. knitting yarn fed to said alternate and intermediate needles and forming a first course of a short fabric tab to connect said stitches of said terminal course of said tube and said yarn bights of said inner terminal course of said second ply on said alternate needles and said inner terminal course of said fourth ply on said intermediate needles.

* * * * *